US009055779B2

(12) United States Patent
Oouchi

(10) Patent No.: US 9,055,779 B2
(45) Date of Patent: Jun. 16, 2015

(54) BICYCLE SHOE

(75) Inventor: Kaoru Oouchi, Osaka (JP)

(73) Assignee: Shimano Inc., Osaka (JP)

( * ) Notice: Subject to any disclaimer, the term of this patent is extended or adjusted under 35 U.S.C. 154(b) by 511 days.

(21) Appl. No.: 13/569,661

(22) Filed: Aug. 8, 2012

(65) Prior Publication Data

US 2014/0041259 A1 Feb. 13, 2014

(51) Int. Cl.
*A43B 5/14* (2006.01)
*A43C 11/14* (2006.01)

(52) U.S. Cl.
CPC ..... *A43B 5/14* (2013.01); *A43C 11/1493* (2013.01)

(58) Field of Classification Search
CPC ..... A43B 5/14; A43C 11/1493
USPC ..... 36/50.1, 138
See application file for complete search history.

(56) References Cited

U.S. PATENT DOCUMENTS 4,845,864 A * 7/1989 Corliss ..... 36/131
7,487,603 B2 * 2/2009 Davis et al. ..... 36/50.1
7,490,417 B2 * 2/2009 Petrie ..... 36/50.1
2004/0134100 A1 * 7/2004 McVicker ..... 36/50.1
2008/0098626 A1 * 5/2008 Wright ..... 36/136
2009/0293318 A1 12/2009 Garneau et al.
2009/0300947 A1 12/2009 Babolat
2013/0036626 A1 * 2/2013 Briant ..... 36/58.5

FOREIGN PATENT DOCUMENTS

DE 69424408 T2 12/2000
DE 202008017627 U1 6/2010
EP 0686360 A1 12/1995
EP 1683436 A1 * 7/2006 ..... A43B 3/18
FR 2615074 A1 11/1988

* cited by examiner

*Primary Examiner* — Ted Kavanaugh
(74) *Attorney, Agent, or Firm* — Global IP Counselors

(57) ABSTRACT

A bicycle shoe includes a sole, a shoe upper portion, and a fixing strap. The shoe upper portion is coupled to the sole to form a foot receiving space. The shoe upper portion includes first and second attachment sections. The fixing strap has a proximal end attached to a part of the shoe upper portion. The fixing strap includes third and fourth attachment sections. The shoe upper portion and the fixing strap selectively maintain one of a first state in which the third attachment section of the fixing strap is releasably attached to the first attachment section of the shoe upper portion and a second state in which the fourth attachment section of the fixing strap is releasably attached to the second attachment section of the shoe upper portion. The foot receiving space is larger in the second state than in the first state.

16 Claims, 9 Drawing Sheets

BICYCLE SHOE

BACKGROUND

1. Field of the Invention

This invention generally relates to a bicycle shoe. More specifically, the present invention relates to a bicycle shoe having a fixing strap.

2. Background Information

Bicycle shoes preferably include a cleat structure that attaches to a binding structure of a bicycle pedal of a bicycle. The cleat structure of the bicycle shoes can include a cleat that releasably attaches to a cleat engaging portion of the binding structure. Bicycle shoes can also include one or more fixing straps with loop and hook fasteners that are used to secure the bicycle shoes to rider's feet.

There are circumstances when a rider desires to put on the bicycle shoes quickly while the cleat structure of the bicycle shoes is engaged with the binding structure of the bicycle. For example, in the case of bicycle shoes for triathlon, easy entry of the rider's feet into the bicycle shoes is desired. Specifically, in a triathlon competition, which involves three continuous and sequential events, i.e., swimming, cycling and running, triathletes put on the bicycle shoes upon transitioning from swimming to cycling. However, since the time spend in the transition is included in the overall time of the competition, triathletes can not afford to waste time to put on the bicycle shoes. Thus, in most cases, the triathletes leave the bicycle shoes attached to the bicycle pedals of the bicycle in advance such that they can slip the feet into the bicycle shoes upon riding the bicycle.

In view of the above, it will be apparent to those skilled in the art from this disclosure that there exists a need for an improved bicycle shoe with that can be easily put on the rider's foot. The present disclosure addresses this need in the art as well as other needs, which will become apparent to those skilled in the art from this disclosure.

SUMMARY

One aspect is to provide to a bicycle shoe that aids easy entry of a rider's foot into the bicycle shoe.

In view of the state of the known technology, a bicycle shoe is provided that basically includes a sole, a shoe upper portion, and a fixing strap. The shoe upper portion is coupled to the sole to form a foot receiving space. The shoe upper portion includes first and second attachment sections. The fixing strap has a proximal end attached to a part of the shoe upper portion. The fixing strap includes third and fourth attachment sections. The shoe upper portion and the fixing strap selectively maintain one of a first state in which the third attachment section of the fixing strap is releasably attached to the first attachment section of the shoe upper portion and a second state in which the fourth attachment section of the fixing strap is releasably attached to the second attachment section of the shoe upper portion. The foot receiving space is larger in the second state than in the first state.

Other objects, features, aspects and advantages of the disclosed bicycle shoe will become apparent to those skilled in the art from the following detailed description, which, taken in conjunction with the annexed drawings, discloses preferred embodiment of the bicycle shoe.

BRIEF DESCRIPTION OF THE DRAWINGS

Referring now to the attached drawings which form a part of this original disclosure.

DETAILED DESCRIPTION OF EMBODIMENTS

A preferred embodiment will now be explained with reference to the drawings. It will be apparent to those skilled in the art from this disclosure that the following descriptions of the embodiment are provided for illustration only and not for the purpose of limiting the invention as defined by the appended claims and their equivalents.

Figure 1:
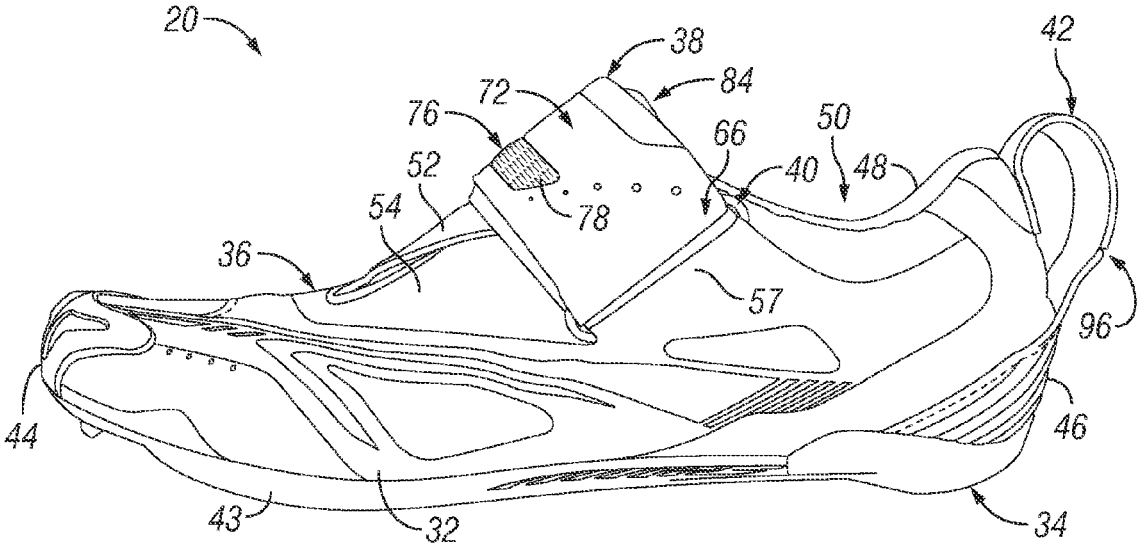
FIG. 1 is a side elevational view of a bicycle shoe in accordance with one embodiment, showing a fixing strap fastened in a fastened state.

Referring initially to FIG. 1, a bicycle shoe 20 is illustrated in accordance with one embodiment. The bicycle shoe 20 is releasably secured to a shoe binding structure of a bicycle (not shown) in a conventional manner. Since the bicycle and the shoe binding structure are not essential elements, further description thereof is omitted for the sake of brevity.

Referring further to FIGS. 1-15, a detailed description of the bicycle shoes 20 is now provided. There are two bicycle shoes 20. However, the bicycle shoes 20 are identical to one another except that they are mirror images of one another, one for the left foot and one for the right foot. Accordingly, description of one of the bicycle shoes 20 applies equally to the other of the bicycle shoes 20. Therefore, description will be provide for only one of the bicycle shoes 20, but applies equally to both bicycle shoes 20.

Figure 2:
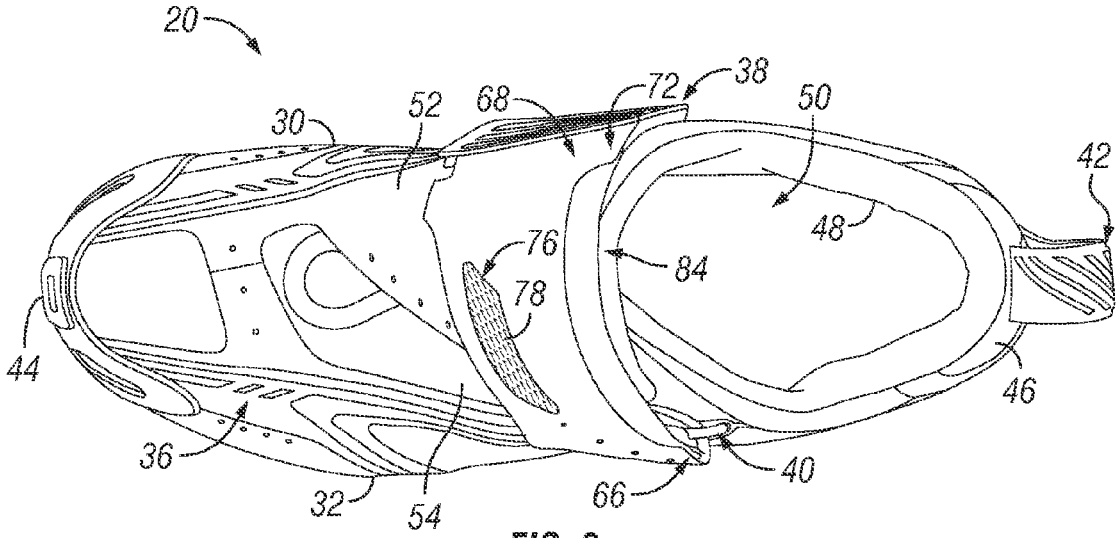
FIG. 2 is a top plan view of the bicycle shoe illustrated in FIG. 1, showing the fixing strap fastened in the fastened state.

As shown in FIGS. 1 and 2, the bicycle shoe 20 includes an inboard side 30, an outboard side 32, a sole 34, a shoe upper portion 36 and a fixing strap 38. The bicycle shoe further includes a strap ring 40 and a heel strap 42. It should be understood from the drawings and the description herein that the term inboard side refers to the right side of a shoe for the left foot, and the left side of a shoe for the right foot. In other words the inboard side is the side of the shoe facing the shoe on the other foot of the wearer. Similarly, the term outboard side refers to the left side of the shoe for the left foot and the right side of the shoe for the right foot. The outboard side is the side of the shoe facing away from the shoe on the other foot. As well, the terms inner side and inboard side are used interchangeably with respect to the present disclosure. Similarly, the terms outer side and outboard side are also used interchangeably with respect to the description of the present disclosure.

The sole 34 includes a cleat mounting portion 43 that is configured such that a conventional cleat structure (not shown) is mountable thereto. The sole 34 is made of a resilient but relatively rigid polymer or plastic material (with some small degree of resilient flexibility). Also, the cleat mounting portion 43 includes a plurality of threaded holes dimensioned to receive a plurality of fasteners that secure the cleat structure to the sole 34. The cleat structure mounted to the sole 34 is releasably attached to the shoe binding structure of the bicycle. Since the constructions of the sole 34 and the cleat structure are conventional, further description thereof is omitted for the sake of brevity.

The shoe upper portion 36 includes a toe end 44 (e.g., a toe portion), a heel end 46 (e.g., a heel portion), a foot opening 48, an overlapping section 52 (e.g., a first flap part) and an under-lapping section 54 (e.g., a second flap part). It should also be understood from the drawings and the description herein that the shoe upper portion 36 at least partially defines the inboard side 30 and the outboard side 32 of the bicycle shoe 20. Hence, the inboard side 30 and the outboard side 32 refer to both the bicycle shoe 20 and the shoe upper portion 36.

The shoe upper portion 36 is made from any of a plurality of materials or combination of materials, such as leather, leather-like materials, polymer materials, plastic materials and textile materials. For instance, the shoe upper portion 36 can include sections made of air permeable materials that allow for the interior of the bicycle shoe 20 to breathe or ventilate. The various sections of the shoe upper portion 36 are stitched or otherwise fixed to one another. Since the present disclosure is applicable to a variety of differing shoe styles, designs and configuration, the depicted embodiment shows a basic shoe design that is made of several textile based materials that are sewn or stitched together to form the depicted shape. However, the present disclosure is not limited to the depicted shape, as will be understood from the description of the present disclosure below. The shoe upper portion 36 is fixed to the sole 34 in a conventional manner, such as with stitching, adhesives, and/or embedding portions thereof within the sole 34, which forms a foot receiving space 50 of the bicycle shoe 20.

In the depicted embodiment, the overlapping section 52 of the shoe upper portion 36 is basically an elongated portion of the inboard side 30 of the shoe upper portion 36. More specifically, the material that forms the inboard side 30 of the shoe upper portion 36 is sufficiently long to enable the overlapping section 52 to extend over the top of the bicycle shoe 20 and overlie at least a portion the under-lapping section 54 while the fixing strap 38 is properly tightened around the rider's foot.

As shown in FIGS. 1 and 2, the under-lapping section 54 is basically an elongated portion of the outboard side 32 of the shoe upper portion 36 that extends upward from the sole 34. The under-lapping section 54 can be dimensioned to extend to and over the top of the rider's foot when the rider is wearing the bicycle shoe 20. The actual size and length of the under-lapping section 54 can vary depending upon the overall shoe design and is not limited to the depicted relative dimensions and shape.

Figure 9:
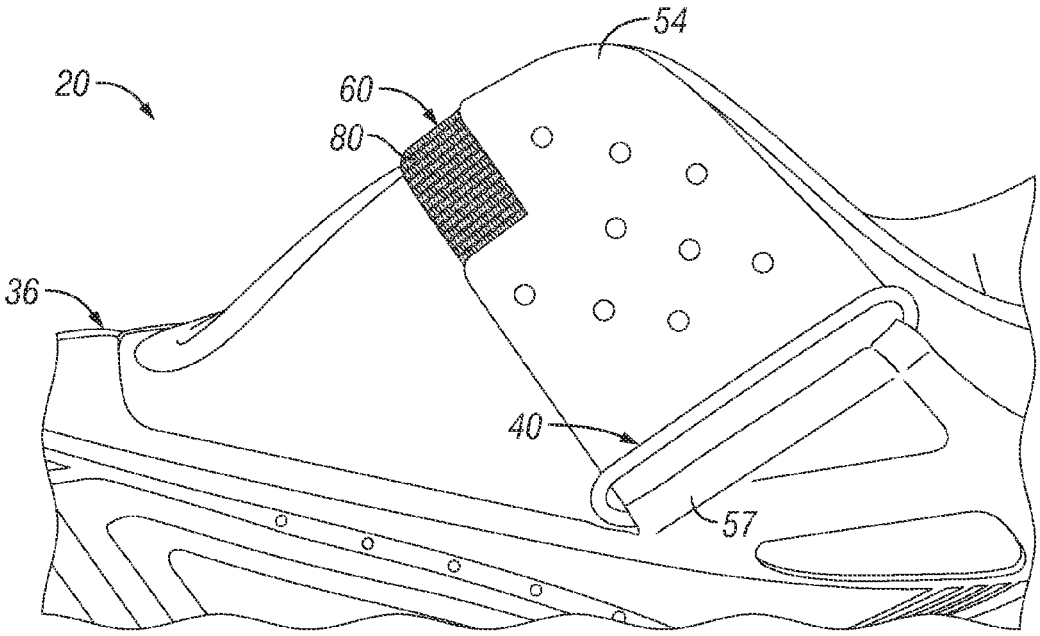
FIG. 9 is an enlarged, side elevational view of the bicycle shoe illustrated in FIG. 1, showing a second attachment section of the hook and loop faster attachment of the bicycle shoe.

As best shown in FIGS. 1 and 9, the under-lapping section 54 includes a loop section 57 that loops around the strap ring 40. In other words, the strap ring 40 is attached to the loop section 57 (e.g., a part) of the shoe upper portion 36. The loop section 57 is located adjacent to but spaced apart from the sole 34 on the outboard side 32 of the shoe upper portion 36. The loop section 57 is securely fixed to the outboard side of the shoe upper portion 36 via a sewn seam or stitching. Alternatively, the loop section 57 and the under-lapping section 54 can be formed from a single element or section, with a portion of the loop section 57 partially cut out from the under-lapping section 54 and then sewn or stitched to itself forming a loop. The loop section 57 encircles one portion of the strap ring 40. The strap ring 40 is a rigid ring-like member, such as metallic member, that has an overall rectangular shape with a central aperture that receives the loop section 57 and a portion of the fixing strap 38, as described in detail below.

Figure 7:
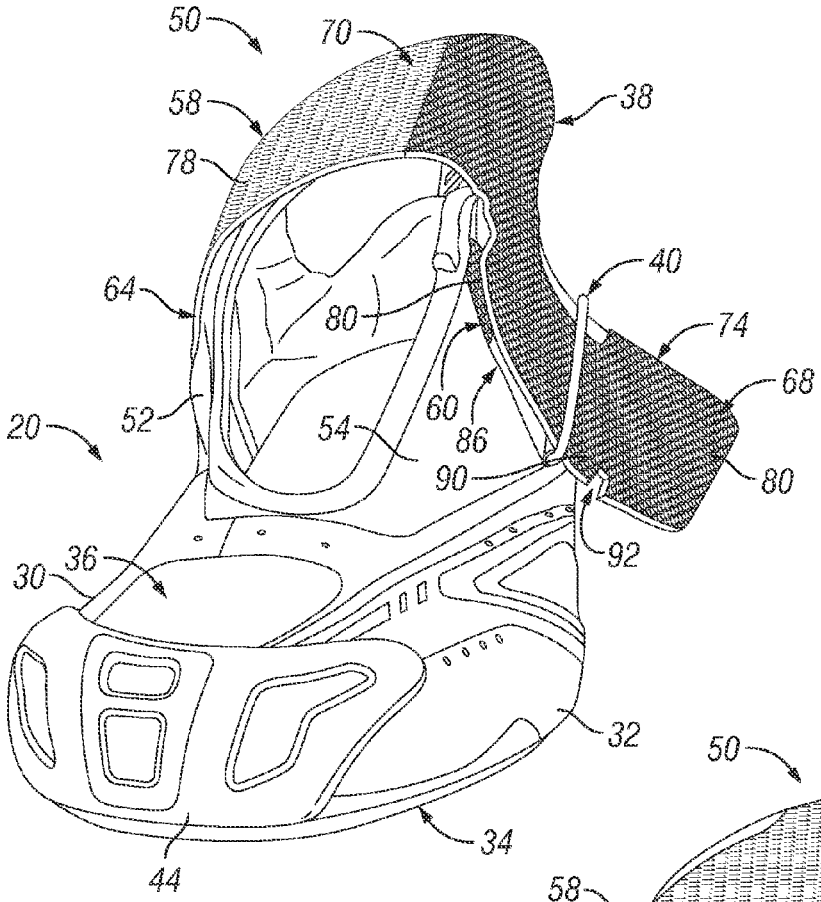
FIG. 7 is a front perspective view of the bicycle shoe illustrated in FIG. 1, showing the fixing strap loosened in the easy-entry state with a hook and loop faster attachment of the bicycle shoe fastened together.
Figure 8:
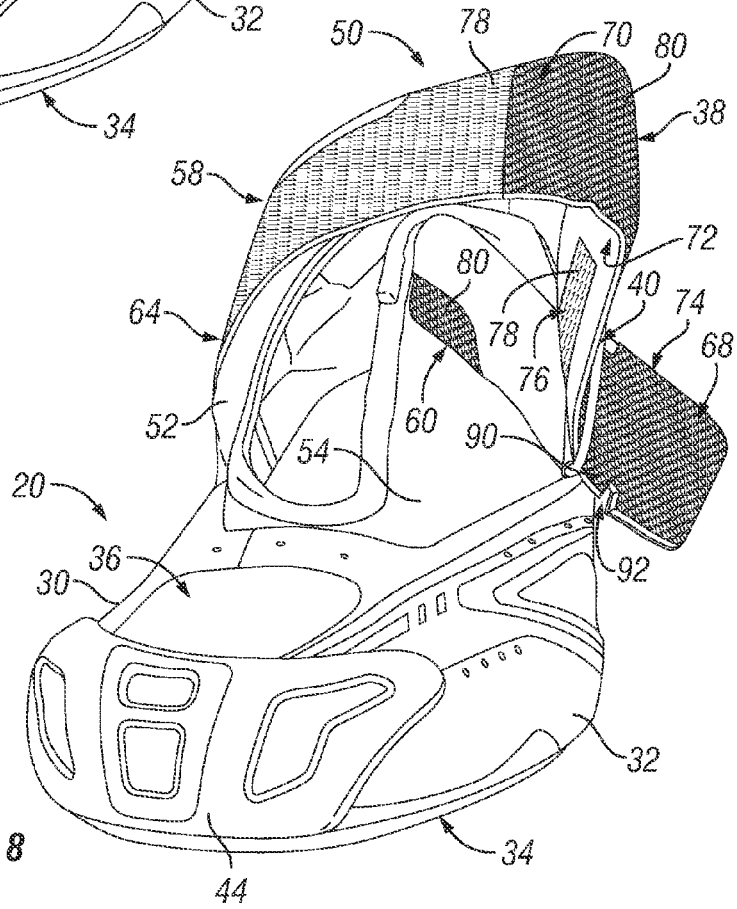
FIG. 8 is a front perspective view of the bicycle shoe illustrated in FIG. 1, showing the fixing strap loosened in the easy-entry state with the hook and loop faster attachment of the bicycle shoe released from each other.

The overlapping section 52 and the under-lapping section 54 are spaced apart from each other in a traverse direction of the bicycle shoe 20 while the rider leaves the bicycle shoe 20 attached to the bicycle in advance such that the rider can slip the rider's foot into the bicycle shoe 20, as best shown in FIGS. 7 and 8. As shown in FIGS. 3, 4 and 6-8, the shoe upper portion 36 further includes first and second attachment sections 58 and 60. The first attachment section 58 is disposed on the overlapping section 52 of the shoe upper portion 36. The second attachment section 60 is disposed on the under-lapping section 54 of the shoe upper portion 36. The first and second attachment sections 58 and 60 of the shoe upper portion 36 are spaced apart from each other. As best shown in FIGS. 7 and 8, the second attachment section 60 of the shoe upper portion 36 is smaller than the first attachment section 58 of the shoe upper portion 36. The detailed constructions of the first and second attachment sections 58 and 60 will be described in detail below.

The fixing strap 38 is configured to secure the shoe upper portion 36 to the rider's foot. As best shown in FIGS. 1-4, the fixing strap 38 includes a proximal end 64, a looping section 66 and a free end 68. Furthermore, as best shown in FIGS. 7 and 8, the fixing strap 38 has first and second surfaces 70 and 72 with third and fourth attachment sections 74 and 76, respectively. Specifically, the third attachment section 74 of the fixing strap 38 is disposed on the first surface 70 of the fixing strap 38, while the fourth attachment section 76 of the fixing strap 38 is disposed on the second surface 72 of the fixing strap 38. The second surface 72 of the fixing strap 38 is opposite the first surface 70 of the fixing strap 38. Thus, the third and fourth attachment sections 74 and 76 of the fixing strap 38 are spaced apart from each other. As best shown in FIGS. 7 and 8, the fourth attachment section 76 of the fixing strap 38 is smaller than the third attachment section 74 of the fixing strap 38. The detailed constructions of the third and fourth attachment sections 74 and 76 will be described in detail below.

Figure 3:
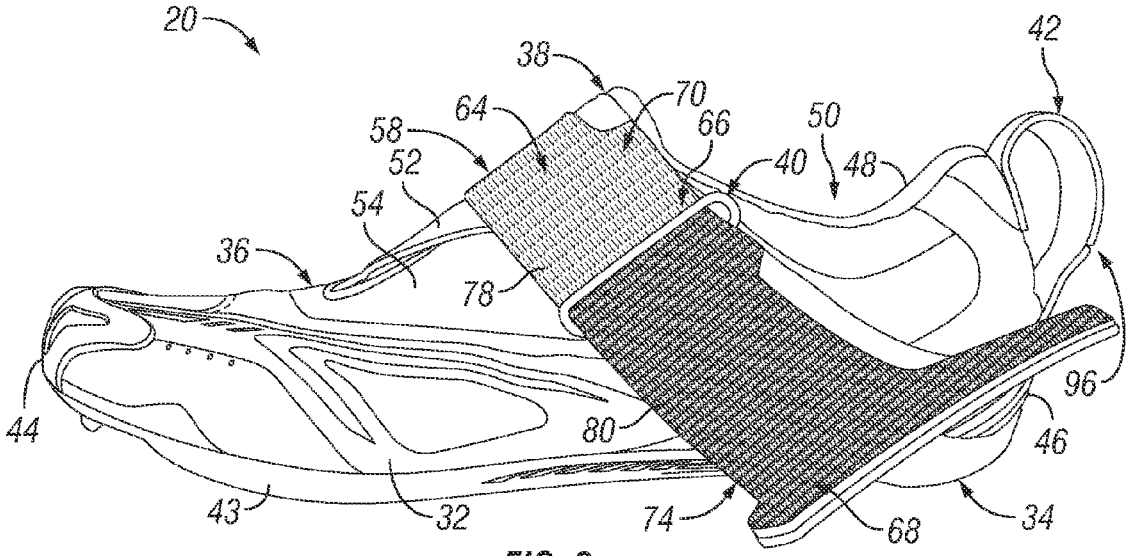
FIG. 3 is a side elevational view of the bicycle shoe illustrated in FIG. 1, showing the fixing strap released in a released state.
Figure 4:
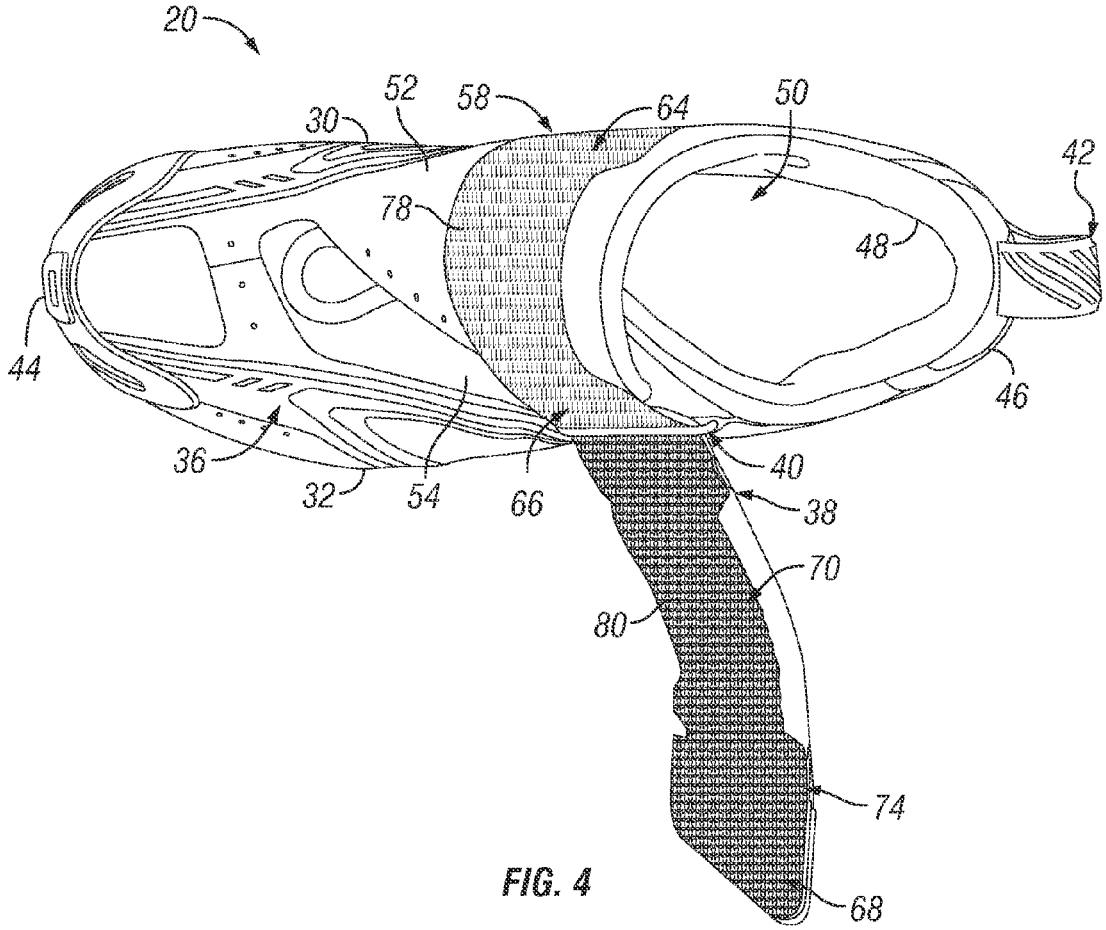
FIG. 4 is a top plan view of the bicycle shoe illustrated in FIG. 3, showing the fixing strap released in the released state.
Figure 5:
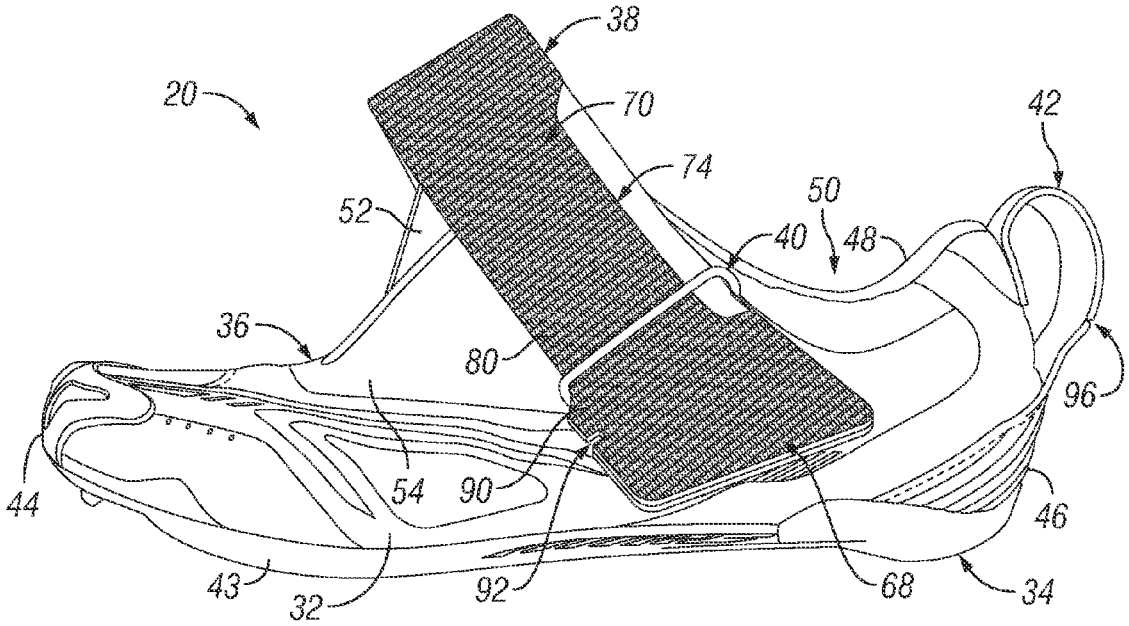
FIG. 5 is a side elevational view of the bicycle shoe illustrated in FIG. 1, showing the fixing strap loosened in an easy-entry state.
Figure 6:
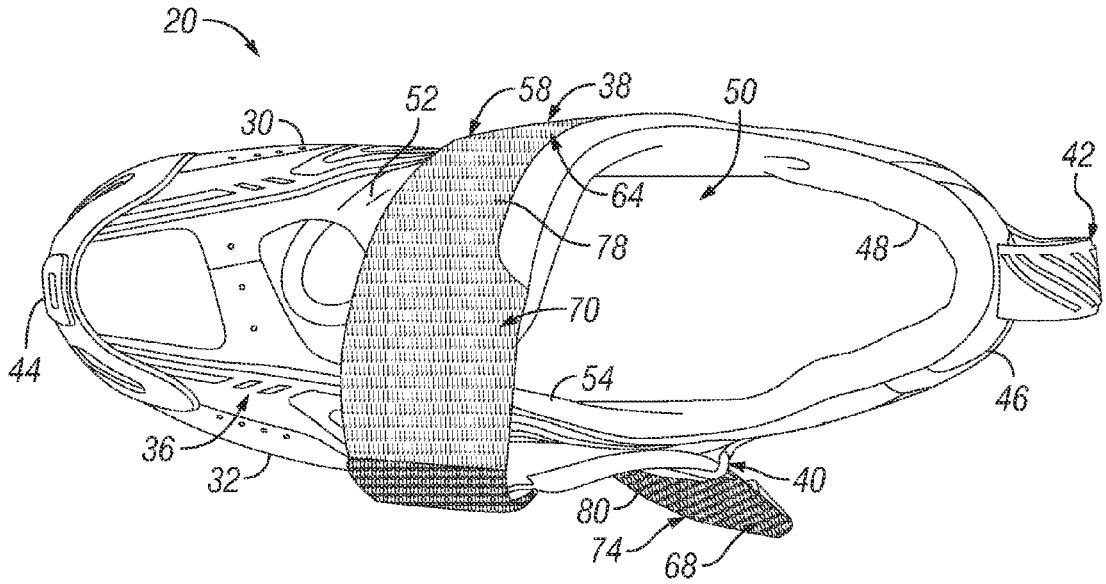
FIG. 6 is a top plan view of the bicycle shoe illustrated in FIG. 5, showing the fixing strap loosened in the easy-entry state.

The fixing strap 38 secures the bicycle shoe 20 on the rider's foot. The fixing strap 38 extends from the overlapping section 52 of the shoe upper portion 36. Specifically, the proximal end 64 is located at the inboard side 30 of the shoe upper portion 36 on the overlapping section 52, as best shown in FIGS. 3 and 4. The proximal end 64 is positioned closer to the foot opening 48 of the shoe upper portion 36 than the toe end 44. The proximal end 64 is fixed to the shoe upper portion 36 by sewing or stitching. The proximal end 64 overlies the top of the bicycle shoe 20 and a portion of the overlapping section 52 near the foot opening 48. The proximal end 64 of the fixing strap 38 is attached to the overlapping section 52 of the shoe upper portion 36.

As best shown in FIGS. 3 and 4, the first attachment section 58 of the shoe upper portion 36 at least partially forms the proximal end 64 of the fixing strap 38. In particular, in the illustrated embodiment, the first attachment section 58 extends from the proximal end 64 to the looping section 66. The first attachment section 58 includes a first material 78 of loop and hook fastening materials on the first surface 70 of the fixing strap 38. The third attachment section 74 of the fixing strap 38 is disposed between the looping section 66 and the free end 68 of the fixing strap 38. The third attachment section 74 includes a second material 80 of the loop and hook fastening materials on the first surface 70 of the fixing strap 38. In other words, the fixing strap 38 is attached to the shoe upper portion 36 so that the third attachment section 74 directly extends from the first attachment section 58 along the fixing strap 38. The first attachment section 58 of the shoe upper portion 36 is releasably attachable to the third attachment section 74 of the fixing strap 38. In particular, the first attachment section 58 of the shoe upper portion 36 and the third attachment section 74 of the fixing strap 38 form a hook and loop fastener attachment 84, as shown in FIGS. 1 and 2. The first material 78 of the loop and hook fastening materials features tiny hooks, while the second material 80 of the loop and hook fastening materials features loops. In the illustrated embodiment, the first attachment section 58 includes the first material 78 while the third attachment section 74 includes the second material 80. On the other hand, alternatively, the first attachment section 58 can include the second material 80 (i.e., loops), and the third attachment section 74 can include the first material 78 (i.e., tiny hooks).

Figure 10:
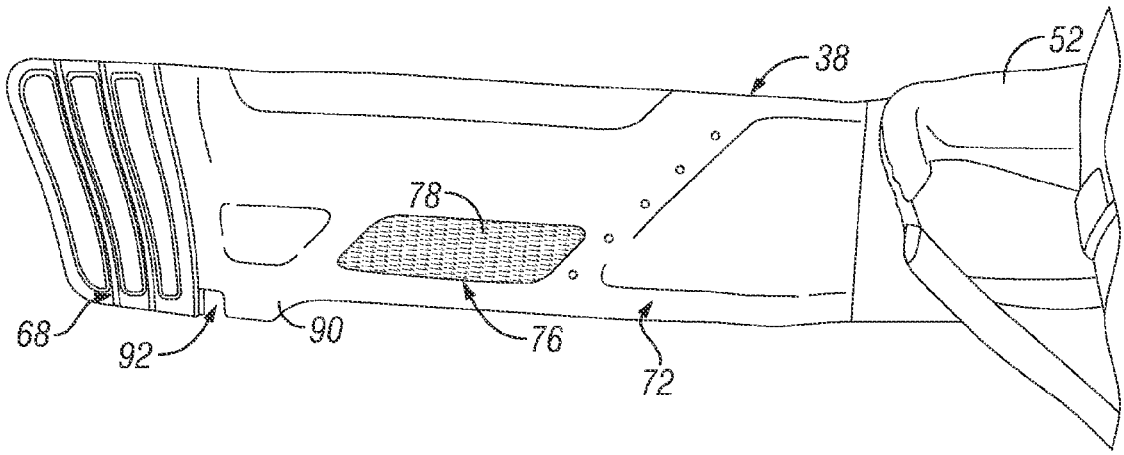
FIG. 10 is an enlarged, top plan view of a fixing strap of the bicycle shoe illustrated in FIG. 1, showing a fourth attachment section of the hook and loop faster attachment of the bicycle shoe.

As best shown in FIG. 9, the second attachment section 60 is disposed on an edge portion of the under-lapping section 54 of the shoe upper portion 36. The second attachment section 60 includes the second material 80 of the loop and hook fastening materials on an outer surface of the under-lapping section 54. The second attachment section 60 is arranged relative to the under-lapping section 54 such that the second attachment section 60 is overlaid by the overlapping section 52 while the first attachment section 58 is attached to the third attachment section 74. The second material 80 of the second attachment section 60 is securely fixed to the under-lapping section 54 via a sewn seam or stitching. As best shown in FIG. 10, the fourth attachment section 76 is disposed on the second surface 72 of the fixing strap 38 fixedly coupled to the overlapping section 52. The fourth attachment section 76 includes the first material 78 of the loop and hook fastening materials in a lengthwise midst portion of the fixing strap 38 on the second surface 72 of the fixing strap 38. As best shown in FIGS. 1 and 2, the fourth attachment section 76 is arranged relative to the fixing strap 38 such that the fourth attachment section 76 is disposed on the top of the bicycle shoe 20 while the first attachment section 58 is attached to the third attachment section 74. The first material 78 of the fourth attachment section 76 is securely fixed to the fixing strap 38 via a sewn seam or stitching. As best shown in FIG. 7, the second attachment section 60 of the shoe upper portion 36 is releasably attachable to the fourth attachment section 76 of the fixing strap 38. In particular, the second attachment section 60 of the shoe upper portion 36 and the fourth attachment section 76 of the fixing strap 38 form a hook and loop fastener attachment 86. In the illustrated embodiment, the second attachment section 60 includes the second material 80, while the fourth attachment section 76 includes the first material 78. On the other hand, alternatively, the second attachment section 60 can include the first material 78 (i.e., tiny hooks), and the fourth attachment section 76 can include the second material 80 (i.e., loops).

Figure 11:
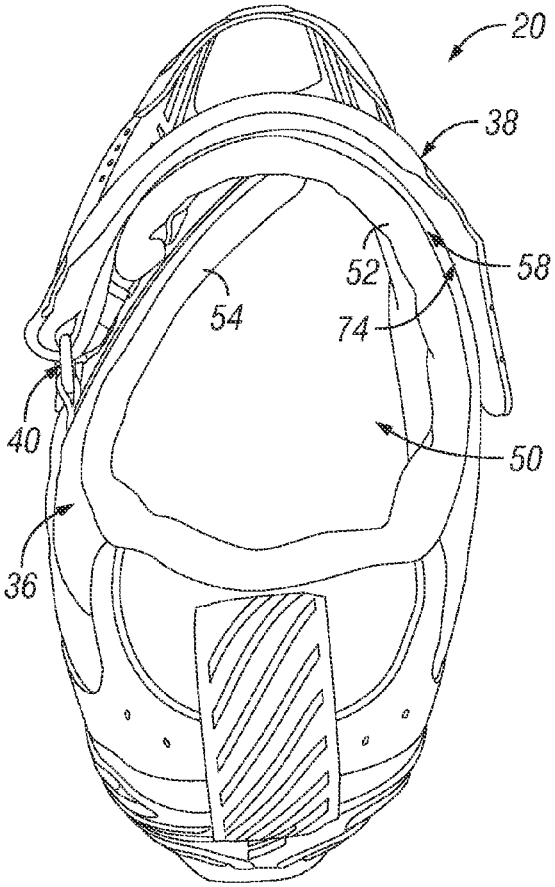
FIG. 11 is a rear perspective view of the bicycle shoe illustrated in FIG. 1, showing the fixing strap fastened in the fastened state.

The fixing strap 38 is fixedly attached to the overlapping section 52 of the shoe upper portion 36. The fixing strap 38 is fed through and extends through the strap ring 40 such that the looping section 66 of the fixing strap 38 usually contacts the strap ring 40. When the free end 68 of the fixing strap 38 is pulled from the outboard side 32 of the bicycle shoe 20 toward the inboard side 30 of the bicycle shoe 20 after extending through the strap ring 40, the looping section 66 interacts with the strap ring 40 to draw the outboard side 32 and the inboard side 30 of the shoe upper portion 36 toward one another. Further, the overlapping section 52 is pulled over a large portion of the under-lapping section 54. When the third attachment section 74 is brought into contact with the first attachment section 58, the first and second materials 78 and 80 of the loop and hook fastener materials secure the fixing strap 38 in a tightened orientation, which tighten the shoe upper portion 36 to the rider's foot. Specifically, as best shown in FIGS. 1, 2 and 11, the fixing strap 38 extends through the strap ring 40 and loops back towards the overlapping section 52 of the shoe upper portion 36 when the third attachment section 74 of the fixing strap 38 is attached to the first attachment section 58 of the shoe upper portion 36. As a result, the over lapping section 52 and the under-lapping section 54 of the shoe upper portion 36 overlap with each other when the third attachment section 74 of the fixing strap 38 is attached to the first attachment section 58 of the shoe upper portion 36. In this case, the shoe upper portion 36 and the fixing strap 38 maintains a fastened state (e.g., a first state) in which the third attachment section 74 of the fixing strap 38 is releasably attached to the first attachment section 58 of the shoe upper portion 36. While maintaining the fastened state, the size of the foot receiving space 50 is decreased such that the size of the foot receiving space 50 substantially corresponds to the size of the rider's foot.

Figure 12:
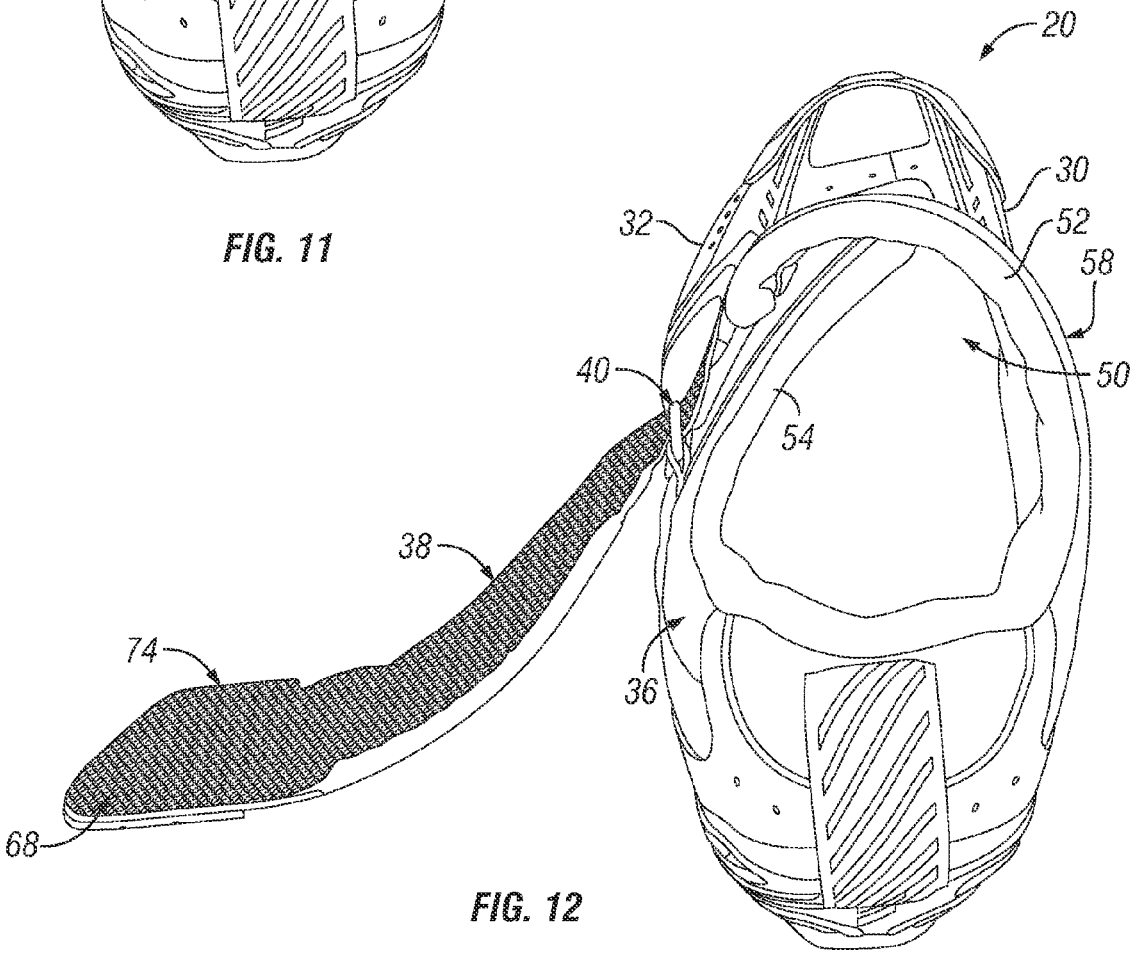
FIG. 12 is a rear perspective view of the bicycle shoe illustrated in FIG. 1, showing the fixing strap released in the released state.

As best shown in FIGS. 3, 4 and 12, the third attachment section 74 of the fixing strap 38 is released from the first attachment section 58 of the shoe upper portion 36 when the free end 68 of the fixing strap 38 is pulled from the inboard side 30 of the bicycle shoe 20 toward the outboard side 32 of the bicycle shoe 20. In this case, the shoe upper portion 36 and the fixing strap 38 maintain a released state in which the fixing strap 38 is released from the shoe upper portion 36. As best shown in FIG. 12, by merely releasing the fixing strap 38 from the shoe upper portion 36, the size of the foot receiving space 50 does not change relative to the size of the foot receiving space 50 in the fastened state.

As best shown in FIGS. 5-8 and 13, the fixing strap 38 is loosened relative to the strap ring 40 by pulling the fixing strap 38 towards the inboard side 30 of the shoe upper portion 36. As best shown in FIG. 10, the fixing strap 38 includes an enlarged portion 90 at the free end 68. The enlarged portion 90 has a larger width than the central aperture of the strap ring 40. With this enlarged portion 90, once the fixing strap 38 is fed through and extends through the strap ring 40, the enlarged portion 90 prevents the fixing strap 38 from being disengaged from the strap ring 40 even if the fixing strap 38 is pulled towards the inboard side 30 of the shoe upper portion 36, as shown in FIGS. 5-8. Specifically, this enlarged portion 90 maintains the position of the fixing strap 38 relative to the strap ring 40. The enlarged portion 90 further has a notch 92 on an edge of the enlarged portion 90. When the fixing strap 38 is pulled until the strap ring 40 is engaged with the notch 92 of the enlarged portion 90 of the fixing strap 38, the position of the fixing strap 38 relative to the strap ring 40 can further be maintained. Specifically, the fixing strap 38 is prevented from moving relative to the strap ring 40 in both lengthwise directions of the fixing strap 38 by this engagement of the notch 92 and the strap ring 40. While the fixing strap 38 is loosened such that the enlarged portion 90 or the notch 92 is engaged with the strap ring 40, the second and fourth attachment sections 60 and 76 are arranged such that the second and fourth attachment sections 60 and 76 face each other. However, as best shown in FIG. 8, the under-lapping section 54 tends to incline or bend back towards the overlapping section 52 due to the resiliency of the under-lapping section 54 while the fourth attachment section 76 of the fixing strap 38 is released from the second attachment section 60 of the shoe upper portion 36. In this case, the size of the foot receiving space 50 is increased relative to the fastened state and the released state.

Figure 13:
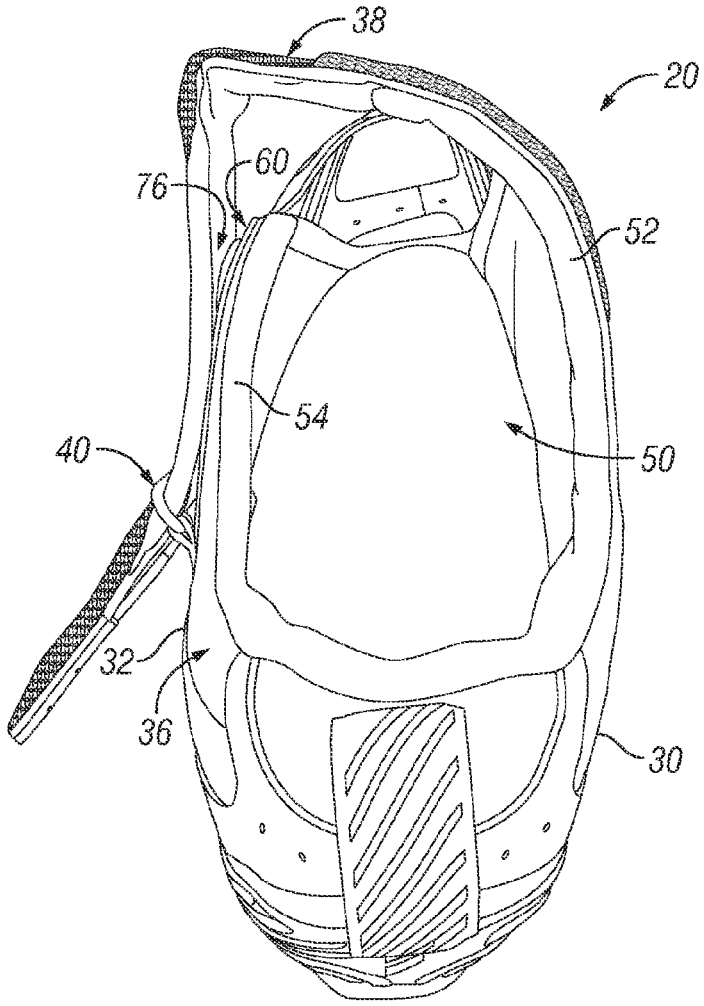
FIG. 13 is a rear perspective view of the bicycle shoe illustrated in FIG. 1, showing the fixing strap loosened in the easy-entry state.

On the other hand, as best shown in FIGS. 7 and 13, when the fourth attachment section 76 of the fixing strap 38 is releasably attached to the second attachment section 60 of the shoe upper portion 36, the overlapping section 52 and the under-lapping section 54 of the shoe upper portion 36 are oriented upright, which further increases the size of the foot receiving space 50. In particular, the under-lapping section 54 is oriented upright such that the under-lapping section 54 extends along the fixing strap 38. Specifically, the under-lapping section 54 is drawn towards the fixing strap 38 while the fourth attachment section 76 of the fixing strap 38 is attached to the second attachment section 60 of the shoe upper portion 36. In this case, the shoe upper portion 36 and the fixing strap 38 maintain an easy-entry state (e.g., a second state) in which the fourth attachment section 76 of the fixing strap 38 is releasably attached to the second attachment section 60 of the shoe upper portion 36. While maintaining the easy-entry state, the size of the foot receiving space 50 is increased relative to the size of the foot receiving space 50 in the fastened or loosened state. Thus, the rider can easily slip the rider's foot into the bicycle shoe 20 upon riding the bicycle. In other words, the foot receiving space 50 is larger in the easy-entry state (see FIG. 13) than in the fastened state (see FIG. 11) or in the released state (see FIG. 12). Specifically, as best shown in FIG. 13, the overlapping section 52 and the under-lapping section 54 are spaced apart from each other in the traverse direction of the bicycle shoe 20 while the fourth attachment section 76 of the fixing strap 38 is releasably attached to the second attachment section 60 of the shoe upper portion 36, thereby allowing the rider to easily slip the rider's foot into the foot receiving space 50 of the bicycle shoe 20.

Furthermore, after the rider slips the rider's foot into the foot receiving space 50 while maintaining the easy-entry state, the free end 68 of the fixing strap 38 is pulled towards the outboard side 32 of the bicycle shoe 20, thereby disengaging the hook and loop fastener attachment 86 between the second and fourth attachment sections 60 and 76. In particular, the sizes of the second and fourth attachment sections 60 and 76 is relatively small compared to the sizes of the first and third attachment sections 58 and 74. Thus, the hook and loop fastener attachment 86 can be easily released with a pulling or shearing force that is created by merely pulling the free end 68 of the fixing strap 38 and that exerts to the hook and loop fastener attachment 86 along an interface of the second and fourth attachment sections 60 and 76. In other words, the second and fourth attachment sections 60 and 76 are dimensioned such that the hook and loop fastener attachment 86 maintains the under-lapping section 54 upright against the resiliency of the under-lapping section 54, which bents the under-lapping section 54 away from the fixing strap 38. Furthermore, when the free end 68 of the fixing strap 38 is pulled from the outboard side 32 of the bicycle shoe 20 toward the inboard side 30 of the bicycle shoe 20, the third attachment section 74 is brought into contact with the first attachment section 58, which tighten the shoe upper portion 36 to the rider's foot. Thus, the rider can easily secure the bicycle shoe 20 on the rider's foot while riding the bicycle.

Figure 14:
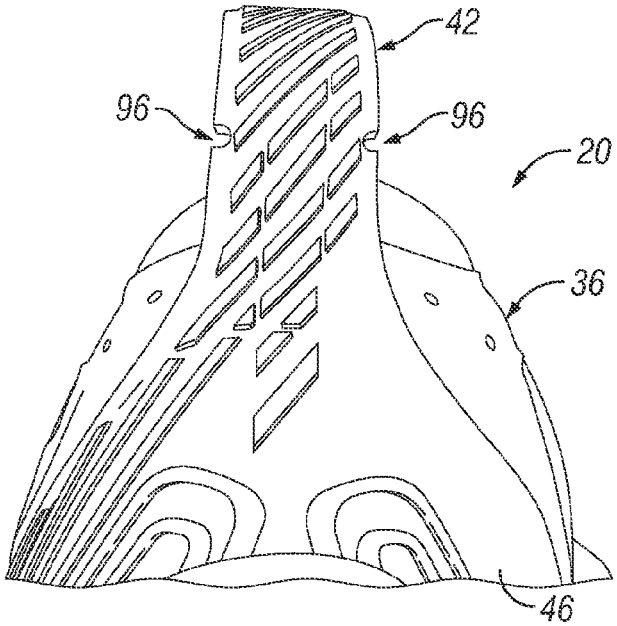
FIG. 14 is an enlarged, rear elevational view of the bicycle shoe illustrated in FIG. 1, showing a heel strap having a notch.
Figure 15:
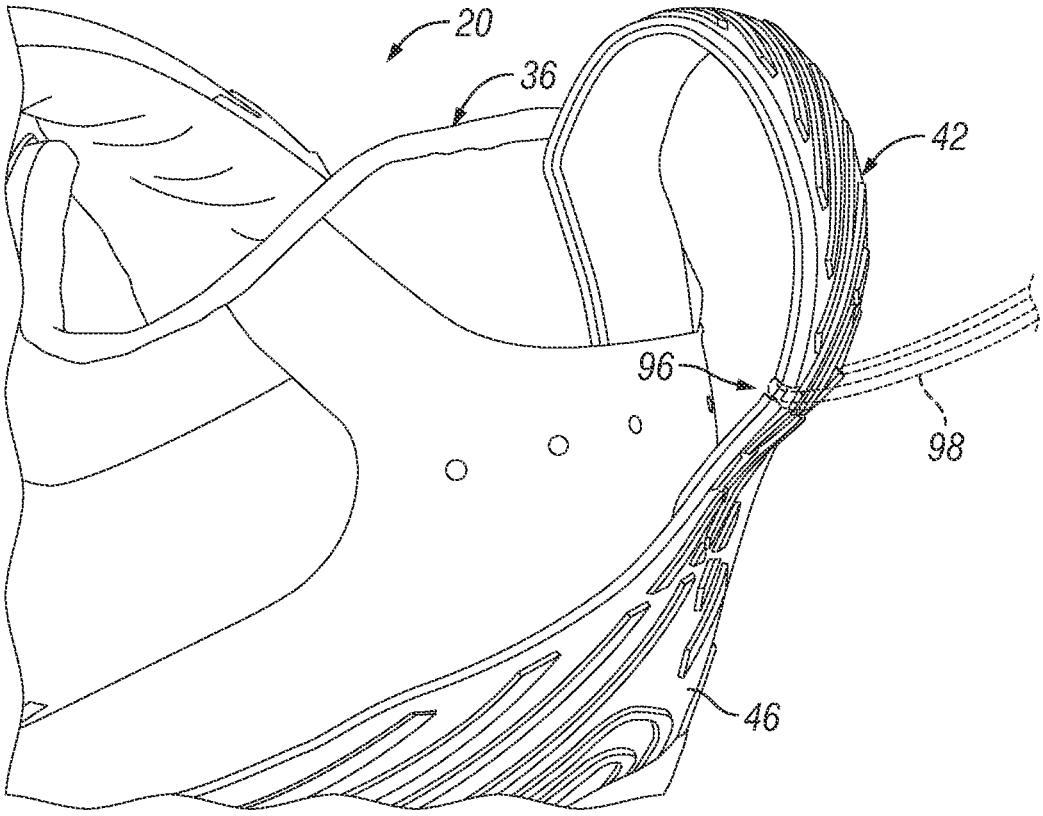
FIG. 15 is an enlarged, perspective view of the bicycle shoe illustrated in FIG. 1, showing the heel strap having the notch.

As best shown in FIGS. 14 and 15, the heel strap 42 is attached to the heel end 46 of the bicycle shoe 20. The heel strap 42 is made of a flexible material such as leather, leather-like materials, polymer materials, plastic materials and textile materials. The heel strap 42 is stitched or otherwise fixed to the heel end 46 of the bicycle shoe 20. Alternatively, the heel strap 42 is integrally formed with the heel end 46. The heel strap 42 has a pair of notches 96. The notches 96 are formed on both widthwise edges of the heel strap 42. As best shown in FIG. 15, in the notches 96, an elastic band 98 is configured to be hooked. Specifically, one part of the elastic band 98 is hooked around the heel strap 42 such that the elastic band 98 extends through the notches 96 of the heel strap 42, while the other end of the elastic band 98 is hooked to a part of a bicycle frame of the bicycle while the rider leave the bicycle shoe 20 attached to the bicycle pedal of the bicycle. The elastic band 98 maintains a rotational orientation of the bicycle shoe 20 about an pedal axle of the bicycle pedal of the bicycle such that the bicycle shoe 20 is prevented from rolling upside down while the rider leaves the bicycle shoe 20 attached to the bicycle pedal of the bicycle before riding the bicycle. Thus, with this heel strap 42, the rider can easily slip the rider's foot into the bicycle shoe 20. After the rider slips the rider's foot into the bicycle shoe 20 and starts pedaling, the elastic band 98 stretches and breaks since the elastic band 98 is formed of synthetic rubber string or other thin string.

Figure 16:
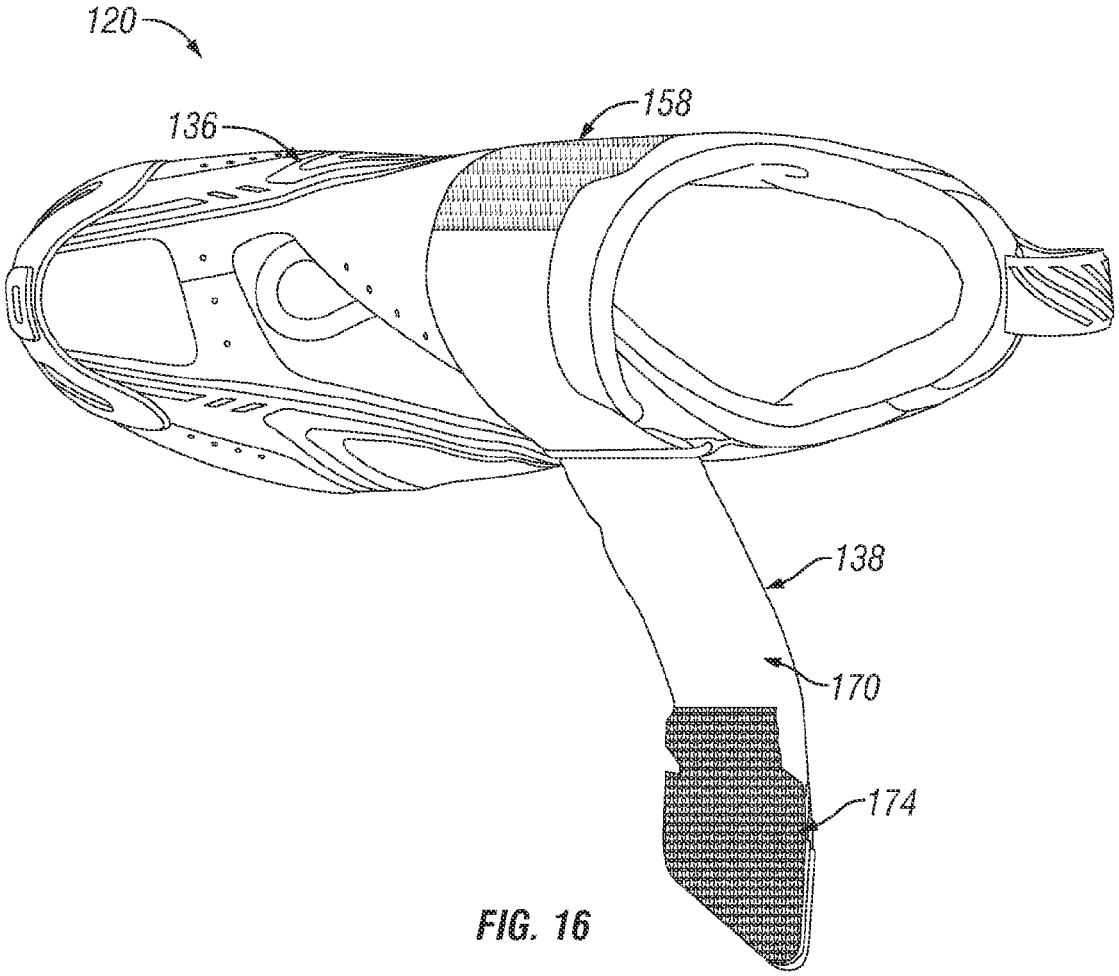
FIG. 16 is a top plan view of a bicycle shoe in accordance with a modified embodiment, showing a modified fixing strap of the bicycle shoe.

Referring to FIG. 16, a modified bicycle shoe 120 will now be explained. In view of the similarity between the bicycle shoes 20 and 120, the parts of the bicycle shoe 120 that are identical to the parts of the bicycle shoe 20 will be given the same reference numerals but with "100" added thereto. Moreover, the descriptions of the parts of the bicycle shoe 120 that are identical to the parts of the bicycle shoe 20 may be omitted for the sake of brevity.

As illustrated in FIG. 4, with the bicycle shoe 20, the third attachment section 74 directly extends from the first attachment section 58 along the fixing strap 38. On the other hand, as best shown in FIG. 16, a fixing strap 138 can be attached to a shoe upper portion 136 such that a modified third attachment section 174 of the fixing strap 138 is spaced apart from a modified first attachment section 158 of the shoe upper portion 136 along the fixing strap 138. In other words, the first and third attachment sections 158 and 174 can be formed smaller, and be disposed at spaced apart locations on a first surface 170 of the fixing strap 138. In this case, the first and third attachment sections 158 and 174 can also be stitched or otherwise fixed to the fixing strap 138. With this arrangement, the loop and hook fastening materials for the first and third attachment sections 158 and 174 become smaller, thereby reducing the manufacturing cost of the bicycle shoe 120.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

While only a preferred embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A bicycle shoe comprising:

a sole;

a shoe upper portion coupled to the sole to form a foot receiving space, the shoe upper portion including first and second attachment sections; and a fixing strap having a proximal end attached to a part of the shoe upper portion, the fixing strap including third and fourth attachment sections, the shoe upper portion and the fixing strap selectively maintaining one of a first state in which the third attachment section of the fixing strap is releasably attached to the first attachment section of the shoe upper portion and a second state in which the fourth attachment section of the fixing strap is releasably attached to the second attachment section of the shoe upper portion, the foot receiving space being larger in the second state than in the first state.

2. The bicycle shoe according to claim 1, wherein the third attachment section of the fixing strap is disposed on a first surface of the fixing strap, and the fourth attachment section of the fixing strap is disposed on a second surface of the fixing strap, the second surface of the fixing strap being opposite the first surface of the fixing strap.

3. The bicycle shoe according to claim 1, wherein the shoe upper portion includes first and second flap parts that are spaced apart from each other, the first attachment section being disposed on the first flap part of the shoe upper portion, the second attachment section being disposed on the second flap part of the shoe upper portion.

4. The bicycle shoe according to claim 3, wherein the fixing strap extends from the first flap part of the shoe upper portion.

5. The bicycle shoe according to claim 4, further comprising a strap ring attached to a part of the shoe upper portion, the fixing strap extending through the strap ring and looping back towards the first flap part of the shoe upper portion when the third attachment section of the fixing strap is attached to the first attachment section of the shoe upper portion.

6. The bicycle shoe according to claim 3, wherein the first and second flap parts of the shoe upper portion overlap with each other when the third attachment section of the fixing strap is attached to the first attachment section of the shoe upper portion.

7. The bicycle shoe according to claim 3, wherein the first and second flap parts of the shoe upper portion are oriented upright when the fourth attachment section of the fixing strap is attached to the second attachment section of the shoe upper portion.

8. The bicycle shoe according to claim 1, wherein the first and second attachment sections of the shoe upper portion are spaced apart from each other.

9. The bicycle shoe according to claim 1, wherein the third and fourth attachment sections of the fixing strap are spaced apart from each other.

10. The bicycle shoe according to claim 1, wherein the second attachment section of the shoe upper portion is smaller than the first attachment section of the shoe upper portion.

11. The bicycle shoe according to claim 1, wherein the fourth attachment section of the fixing strap is smaller than the third attachment section of the fixing strap.

12. The bicycle shoe according to claim 1, wherein the first attachment section of the shoe upper portion and the third attachment section of the fixing strap form a hook and loop fastener attachment.

13. The bicycle shoe according to claim 1, wherein the second attachment section of the shoe upper portion and the fourth attachment section of the fixing strap form a hook and loop fastener attachment.

14. The bicycle shoe according to claim 1, wherein the fixing strap is attached to the shoe upper portion so that the third attachment section directly extends from the first attachment section.

15. The bicycle shoe according to claim 1, wherein the fixing strap is attached to the shoe upper portion so that the third attachment section is spaced apart from the first attachment section.

16. The bicycle shoe according to claim 1, further comprising a heel strap attached to a heel portion of the bicycle shoe, the heel strap having a notch in which an elastic band is configured to be hooked.

* * * * *